US006144143A

United States Patent [19]

Horng et al.

[11] Patent Number: 6,144,143

[45] Date of Patent: Nov. 7, 2000

[54] CYCLOTRON DISPLAYS

[76] Inventors: Herng-Er Horng, 4F, No. 31, Lane 57, Ta Tze Street, Ta Tze, Taipei 104; Wai-Bong Yeung; Kai Yang, both of No. 49, Lane 256, Sec. 3 Nanking E. Road, Taipei, all of Taiwan

[21] Appl. No.: 09/018,219

[22] Filed: Feb. 3, 1998

[51] Int. Cl.[7] ..... H05H 13/00; H05H 65/08

[52] U.S. Cl. ..... 313/62; 313/359.1; 315/502

[58] Field of Search ..... 313/62, 359.1, 313/360.1, 363.1; 315/500, 501, 502

[56] References Cited

U.S. PATENT DOCUMENTS

| | | | |
|---|---|---|---|
| 2,242,888 | 5/1941 | Hollmann | 313/62 |
| 2,243,041 | 5/1941 | McClintock | 313/62 |
| 3,393,336 | 7/1968 | De France | 313/409 |
| 3,411,029 | 11/1968 | Karr | 313/409 X |
| 4,563,703 | 1/1986 | Taylor et al. . | |
| 4,635,105 | 1/1987 | Favreau . | |
| 4,656,390 | 4/1987 | Fukuda et al. | 313/409 |
| 4,792,720 | 12/1988 | Takenaka et al. | 313/409 |
| 5,130,794 | 7/1992 | Ritchey . | |

OTHER PUBLICATIONS

Meyers, Robert A., ed., *Encyclopedia of Physical Science and Technology,* Second Edition, vol. 5, pp. 695–701, Academic Press (San Diego, CA, 1992).

Meyers, Robert A., ed., *Encyclopedia of Physical Science and Technology,* 2nd Edition, vol. 12, pp. 205–221, Academic Press (San Diego, CA 1992.

Whitaker, Jerry C., ed., *The Electronics Handbook*, pp. 367–386, CRC Press, Inc. (Beaverton, OR, 1996).

Whitaker, Jerry C., ed., *The Electronics Handbook*, pp. 1575–1598, CRC Press, Inc. (Beaverton, OR, 1996).

Horowitz, Paul and Winfred Hill, eds., *The Art of Electronics,* Second Edition, pp. 490–504, Cambridge University Press (Cambridge, England, 1989).

Millman, Jacob and Christos Halkias, eds., *Integrated Electronics: Analog and Digital Circuits and Systems*, pp. 609–613, McGraw Hill (New York, NY, 1972).

*Primary Examiner*—Nimeshkumar D. Patel
*Assistant Examiner*—Mack Haynes
*Attorney, Agent, or Firm*—McCutchen, Doyle, Brown & Enerson

[57] ABSTRACT

The present invention comprises cyclotron display devices similar to cathode ray tubes (CRTs) in which the CRT electron gun is replaced by one or more cyclotrons that produce electrons using lower voltages and energy costs than a CRT electron gun does. This can be done both with monochrome and color displays, as disclosed. In addition, the electrons emerge from the cyclotron with adequate velocity, thus obviating the need for accelerating electrodes. The need for electron focusing is also greatly reduced, or eliminated, since the electrons emerge from the cyclotrons as beams, rather than as diffuse clouds. The cyclotron display assembly can be made to be significantly shorter than the conventional electron gun CRT. In addition, an array of cyclotrons, rather than just a single one, can be used, so that each cyclotron maps to a fractional portion of the video screen. This further shortens the length of the cyclotron display.

15 Claims, 8 Drawing Sheets

| NAME(UNITS) | FORMULA | EXAMPLE 1 | EXAMPLE 2 |
|---|---|---|---|
| electron kinetic energy, $T$ (eV) | | 500 | 500 |
| magnetic field, $B$ (tesla) | | $1.0\times10^{-2}$ | $1.0\times10^{-2}$ |
| electron charge, $q$ (C) | | $1.6\times10^{-19}$ | $1.6\times10^{-19}$ |
| electron mass, $m$ (kg) | | $9.11\times10^{-31}$ | $9.11\times10^{-31}$ |
| voltage of dees, $V_{dees}$ (volt) | | 10 | 10 |
| electron velocity, $v$ (m/s) | $\sqrt{2\cdot T/m}$ | $1.3\times10^{7}$ | $1.3\times10^{7}$ |
| electron orbital radius, $r$ (cm) | $m\cdot v/q\cdot B$ | $7.5\times10^{-1}$ | $7.5\times10^{-1}$ |
| electron orbital period, $\tau$(sec) | $2\cdot\pi\cdot m/q\cdot B$ | $3.58\times10^{-9}$ | $3.58\times10^{-9}$ |
| number of cycle, $n$ | $T/2\cdot V_{dees}$ | 25 | 25 |
| deflector voltage, $V_{def}$(volt) | | 10 | 20 |
| deflector length, $d_{\parallel}$(cm) | | 1 | 1 |
| deflector separation distance, $d_{\perp}$ (cm) | | 0.1 | 0.1 |
| electron horizontal velocity, $v_{\parallel}$ (m/s) | $v$ | $1.3\times10^{7}$ | $1.3\times10^{7}$ |
| deflection vertical velocity, $v_{\perp}$ (m/s) | $\frac{q}{m}\cdot\frac{V_{def}}{d_{\perp}}\cdot\frac{d_{\parallel}}{v_{\parallel}}$ | $1.3\times10^{6}$ | $1.3\times10^{6}$ |
| electron deflected angle, $\theta$ (radian) | $tan^{-1}\left(v_{\perp}/v_{\parallel}\right)$ | $9.97\times10^{-2}$ | $1.97\times10^{-2}$ |
| vertical deflected distance, $s_{\perp}$ (cm) | $1/2\cdot\frac{v_{\perp}}{v_{\parallel}}\cdot d_{\parallel}$ | $5.0\times10^{-2}$ | $1.0\times10^{-1}$ |
| half of screen height, $s$ (cm) | | 1.2 | 1.2 |
| distance between deflector & screen, $d$ (cm) | $s\cdot v_{\parallel}/v_{\perp}$ | $1.2\times10^{1}$ | $0.6\times10^{1}$ |
| minimum distance, $l$ (cm) | $(2\cdot r+d_{\parallel}+d)$ | 14.5 | 8.5 |

FIG. 4.

CYCLOTRON DISPLAYS

FIELD OF THE INVENTION

The described invention is an apparatus for display of images on a screen. The cyclotron display comprises one or more cyclotrons used to produce and accelerate beams of electrons. Deflection mechanisms then direct the electrons toward a phosphor-coated screen which lights up with images. The invention is meant to be a substitute for the cathode ray tube (CRT) and can be used in the same array of machines that the CRT is used for, including, for example, oscilloscopes, computer monitors and television screens.

BACKGROUND

The conventional CRT is a ubiquitous device that is used to display images in a variety of instruments. The CRT includes a cathode as an electron source. The cathode is heated, which causes it to emit a cloud of low-energy electrons. Focusing electrodes narrow this cloud into a beam, control electrodes ensure that the beam flows through the device at an appropriate rate, and accelerating electrodes accelerate the electrons to the requisite energy level (about 500 eV to 1500 eV for low-voltage phosphor screens). The cathode and the accompanying electrodes described above are together commonly referred to as an "electron gun." The beam of electrons then strikes a phosphor-coated screen, which causes the phosphor to emit light. This light produces coherent images because the electrons are appropriately deflected by deflecting electrodes before they strike the screen.

Deflection of the electron beam is effected by two sets of orthogonal deflectors; one that deflects the beam horizontally, and one that deflects the beam vertically. The angle of deflection that can be achieved is proportional to the voltage applied to the deflecting electrodes and inversely proportional to the energy of the beam. For a more detailed discussion of CRT technology, see, e.g., Robert A. Meyers, ed., *Encyclopedia of Physical Science and Technology, Second Edition, Vol.* 5, pp. 695–701, Academic Press (San Diego, Cailf., 1992) and Jerry C. Whitaker, ed., *The Electronics Handbook*, pp. 367–386, CRC Press, Inc. (Beaverton, Oreg., 1996).

For all of its success as a display device, the CRT has significant limitations in terms of power consumption, cost and size. The electron-producing cathode is a high-voltage, high-power device that nonetheless emits electrons in a diffuse cloud with low energy. The electron cloud must be focused and accelerated into a fast, tight beam to be useful. This requires the use of focusing electrodes as well as accelerating electrodes, both of which, but especially the latter, contribute to the high-energy consumption of the CRT. In addition, a long CRT tube is necessary to take advantage of the deflection angle imparted by deflection electrodes (a longer tube means that the electrons will be deflected a greater absolute distance). This problem can be off-set by an increase in the voltage of the deflecting electrodes, but this of course is not an ideal alternative.

Because of these and other limitations, there is a need in the art for an alternative to conventional CRT displays.

SUMMARY OF THE INVENTION

The described invention overcomes the above-mentioned and other limitations of conventional CRT technology by replacing the electron gun assembly of the CRT with one or more cyclotrons, which can produce electrons using lower voltages and less energy than the cathode of the electron gun. In addition, because the electrons initially emerge from the cyclotron with adequate velocity, they do not need to be further accelerated with accelerating electrodes. And because they emerge as electron beams, very little or even no focusing by focusing electrodes is required. Further, an array of cyclotrons, rather than just a single one, can be used to provide the needed electron beams for a screen. Since, with such an array, each individual cyclotron will be mapped to a fractional portion of the screen, the necessary deflection distance will be lessened, which in turn reduces the length of the device. It is worth noting that an array of electron beam sources could be used in a conventional CRT as well, in order to reduce the length of that device. The disclosed invention thus provides for economical, low-energy, flat panel displays with large screen dimensions.

BRIEF DESCRIPTION OF THE DRAWINGS

FIG. 4 shows sample calculations in table form.

DETAILED DESCRIPTION OF THE PREFERRED EMBODIMENTS

The cyclotron display, like the conventional CRT, is evacuated to facilitate delivery of the electron beams with minimal disruption and loss of energy.

CYCLOTRON

Figure 1:
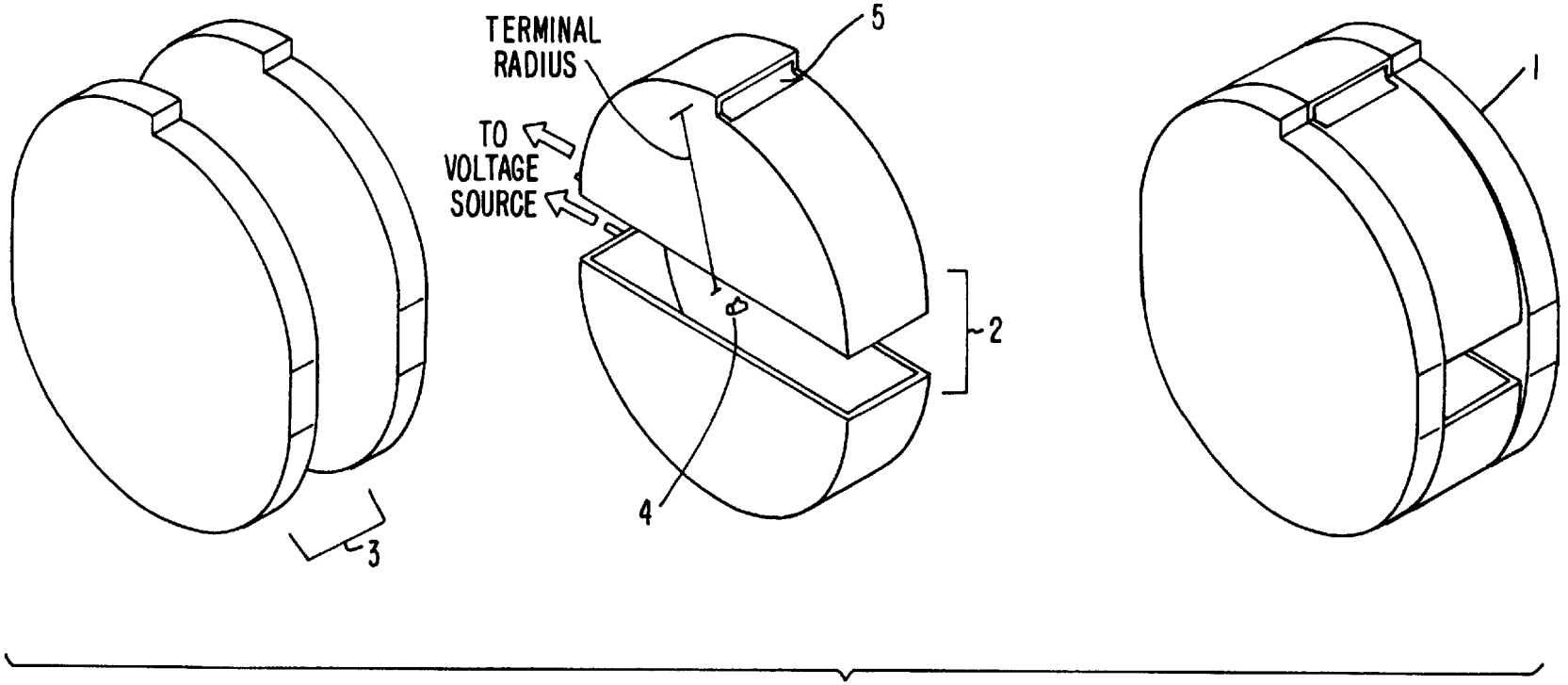
FIG. 1 shows a cyclotron comprised of two metal dees, two magnets and an electron source. It also shows the cyclotron aperture that exists at the terminal radius of the cyclotron.

Every embodiment of the cyclotron display includes at least one cyclotron. The cyclotron is a common device used to accelerate subatomic and atomic particles. The cyclotron 1 resembles a flat metal disk (see FIG. 1). The metal disk comprises two metal halves called dees 2, because of their resemblance to the shape of that letter. The dees 2 are separated by a small empty space or gap. An electric field is generated in the vicinity of this empty space, resulting in a voltage drop across the gap. A uniform magnetic field perpendicular to the plane of the cyclotron and its dees 2 is generated by a pair of magnets 3 (either permanent magnets or Helmholtz coils) that are placed on either side of the dees (see FIG. 1).

A small electron source 4, comprising a thermionic metal-oxide covered cathode or point-discharge cathode, is placed in the center of the cyclotron. The electrons that are emitted from the electron source circulate in the direction of the circumference of the dees because the perpendicular magnetic field keeps them flowing in this direction. As an electron emerges into the gap between the dees, it will experience the voltage drop across the gap, and so accelerate into the other dee, thus picking up velocity and energy. The electron will then be shielded from the electric field by the metal walls of the dee until it emerges into the gap again. At this point, the potential difference between the dees is purposefully reversed, so that the electron will accelerate into the other dee. This process is repeated until the electron is moving fast enough to emerge from the cyclotron aperture 5, when it has reached the "terminal radius" (see FIG. 1).

The time for the electron to complete one orbit in the cyclotron is:

$$\tau = \frac{2 \cdot \pi \cdot m}{q \cdot B}$$

where m is the mass of the electron, q is electron charge, and B is the magnetic field strength.

Note that $\tau$ is independent of the velocity of the electron, which means that the frequency of the orbit, and therefore the frequency at which the electrical potential between the dees must be flipped, remains constant.

The orbital radius of the electron at any moment is:

$$r = \frac{m \cdot \upsilon}{q \cdot B}$$

which, by contrast, is dependent on the velocity of the electron, $\nu$. The electron will continue to accelerate in ever widening circles through the cyclotron until it has reached the terminal radius ($r_{term}$) and terminal velocity ($\nu_{term}$), where the radius of the orbit matches the radius of the cyclotron aperture.

$$r_{term} = \frac{m \cdot \upsilon_{term}}{q \cdot B}$$

The electron energy, $Tre_{req}$, at this point can be determined by:

$$\upsilon_{term} = \sqrt{\frac{2 \cdot T_{req}}{m}}$$

Figure 2:
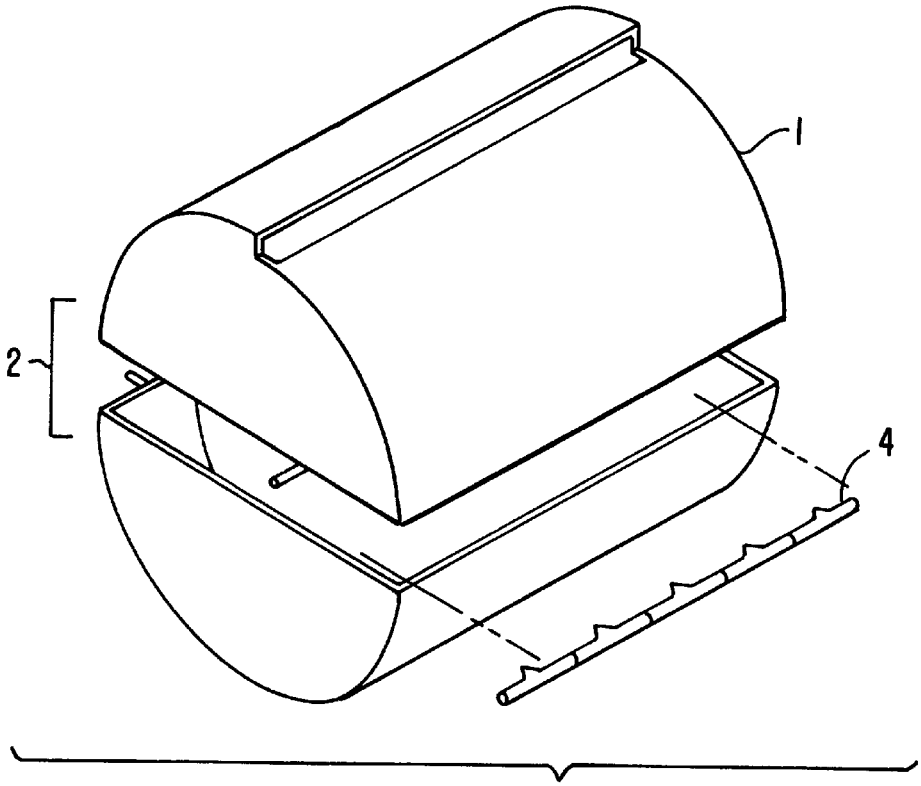
FIG. 2 shows a cylindrical cyclotron with multiple electron sources.

Multiple electron sources can be placed within one cyclotron. The electron sources may comprise several thermionic or point-discharge cathodes, or a single long cathode with multiple pointed protrusions. The electron sources 4 are strung out along one dimension, perpendicular to the plane of the dees 2 (see FIG. 2). This type of cyclotron 1 has a cylindrical shape and produces multiple electron beams. This type of cyclotron 1 can replace multiple cyclotrons with single electron sources, and so replace all or part of an array of cyclotrons (see Examples 7–10 below).

For a more detailed discussion of cyclotron technology, see, e.g., Robert A. Meyers, ed., *Encyclopedia of Physical Science and Technology*, 2 *nd Edition, Vol.* 12, pp. 205–21, Academic Press (San Diego, Cailf. 1992), especially pp. 205–06, 211–12, 219–21.

DEFLECTORS

After emerging from the cyclotron aperture, the electron beam is deflected by either magnetic or electrostatic deflectors, just as it would be if it were emerging from a conventional electron gun. A magnetic deflector is simply a magnetic coil. An electrostatic deflector 6 is a pair of electrostatic plates 7 with a voltage between them (see FIG. 3). Because the disclosed invention is, in its simplest embodiment, directly analogous to the conventional CRT except for the use of a cyclotron instead of an electron gun to produce the electron beam, the principles used to produce video images from an incoming signal in a CRT can also be applied to the disclosed invention. These principles and their application are well-known in the art. For a general description of how signals are processed into coherent images by the modulation and sweeping of an electron beam or beams across a phosphor screen, see, e.g., Jerry C. Whitaker, ed., *The Electronics Handbook*, pp. 1575–98, CRC Press, Inc. (Beaverton, Oreg. 1996).

For an electrostatic deflector, the electric field, E, between the plates is simply $E=V_{def}/d_{\perp}$, where $V_{def}$ is the voltage and $d_{\perp}$ is the distance between the plates. The acceleration, a, that the deflector imparts to a passing electron is a=qE/m. The amount of time that the electron spends passing through the deflector is simply the length the deflector divided by the velocity of the electron, $t=d_{s1}/\nu_{\|}$ (note that $\nu_{\|}$ is the same as $\nu_{term}$).

Assume that the deflector in question, whose length is $d_{\|}$, acts on the vertical axis. Then the vertical velocity of the electron will be the amount of acceleration imparted by the deflector multiplied by the time it takes for that electron to pass through it.

$$\upsilon_{\perp} = a \cdot t = \frac{q \cdot E}{m} \cdot t = \frac{q}{m} \cdot \left(\frac{V_{def}}{d_{\perp}}\right) \cdot \frac{d_{\|}}{\upsilon_{\|}}$$

If we divide through by $\nu_{\|}$, this gives us:

$$\frac{\upsilon_{\perp}}{\upsilon_{\|}} = \left(\frac{q}{m}\right) \cdot \left(\frac{d_{\|}}{d_{\perp}}\right) \cdot V_{def} \cdot \frac{1}{\upsilon_{\|}^2}$$

The total vertical deflection, $s_{\perp}$, achieved is $$\frac{1}{2} \cdot a \cdot t^2:$$

$$s_{\perp} = \frac{1}{2} \cdot a \cdot t^2 = \frac{1}{2} \cdot \left(\frac{q \cdot E}{m}\right) \cdot \left(\frac{d_{\|}}{\upsilon_{\|}}\right)^2 = \frac{1}{2} \cdot \left(\frac{q}{m}\right) \cdot \frac{d_{\|}}{d_{\perp}} \cdot V_{def} \cdot \frac{1}{\upsilon_{\|}^2} \cdot d_{\|}$$

If we substitute $$\frac{\upsilon_{\perp}}{\upsilon_{\|}}$$

into $s_{\perp}$, we get:

$$s_{\perp} = \frac{1}{2} \cdot \frac{\upsilon_{\perp}}{\upsilon_{\|}} \cdot d_{\|}$$

Figure 3:
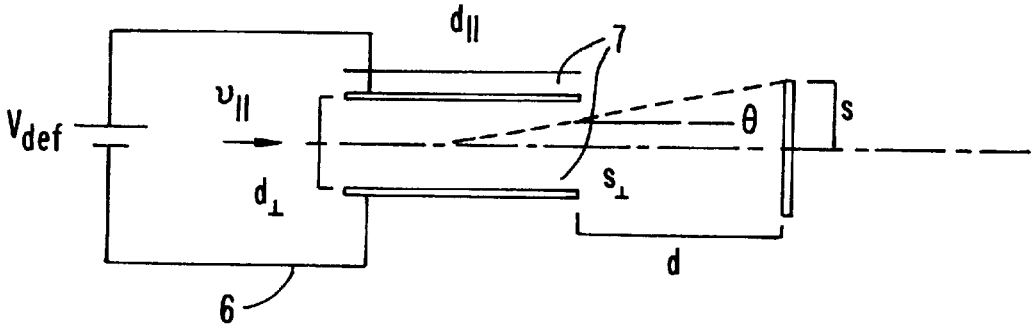
FIG. 3 shows a vertical electrostatic deflector and relevant variables.

A schematic of an electrostatic deflector with relevant variables is shown in FIG. 3.

SAMPLE CALCULATIONS

Assume that the requisite energy for a phosphor screen is 500 eV. The terminal velocity of the electron exiting the cyclotron must be:

$$v_{term} = \sqrt{\frac{2\times 500\,\text{eV}}{9.11\times 10^{-31}\ \text{kg}}} = 1.3\times 10^{7}\ \text{m/s}$$

Assume the cyclotron's magnetic field is $10^{-2}$ Tesla. Then the radius of the cyclotron (which equals both the radius of the aperture and the terminal radius) will be:

$$r_{term} = \frac{m}{q}\times\frac{1.3\times 10^{7}\ m/s}{B} = 7.5\times 10^{-3}\ \text{m}$$

Each orbit of the cyclotron will take $\tau=358\times 10^{-9}$ sec.

If an acceleration voltage of 10V is used between the dees, then it will take 25 cycles to achieve 500 eV (500 eV=25×2×10V), or $8.94\times 10^{-8}$ sec. Therefore electron pulses can easily be generated every $10^{-5}$ sec. Clearly, the same cyclotron/electron source could also easily produce three electron pulses within $10^{-5}$ seconds, and so a single cyclotron/electron source can "simulate" three or more electron sources (such as to produce the three beams necessary for each color pixel on a color screen). See Examples 2 and 3, below, for a further discussion of color screen technology.

If we assume a refresh rate of 0.1 sec for our screen, then $10^4$ pixels can be addressed by this cyclotron. If each pixel is 200 $\mu$m×200 $\mu$m, then we can address a screen area of 2 cm×2 cm. If electron pulses are generated at a higher rate, then the number of pixels that can be addressed will be increased, as will the addressable screen area.

The length of the cyclotron display depends on the distance that the electrons need to be deflected. In this illustration, the electrons will need to be deflected 1.0 cm (2.0cm/2), or to be safe, say 1.2 cm, to cover the screen. If we use an electrostatic deflector of 10V with 0.1 cm between the plates and a plate length of 1 cm, then the deflection velocity will be:

$$v_{\perp} = a\cdot t = \frac{q\cdot E}{m}\cdot t = \frac{q}{m}\cdot\left(\frac{V_{def}}{d_{\perp}}\right)\cdot\frac{d_{\parallel}}{v_{\parallel}} = 1.3\times 10^{6}\ \text{m/s}$$

The distance between the deflector and the screen, d, will need to be only 12 cm to achieve this velocity. The entire cyclotron display unit can be made under 15 cm. A 20V deflector will reduce the distance to 6 cm, which means the display unit can be reduced to 10 cm in length. The potential for flat-screen cyclotron display devices is made clear by these sample calculations. These and other sample calculations are tabulated in FIG. 4.

EXAMPLE 1

Figure 5:
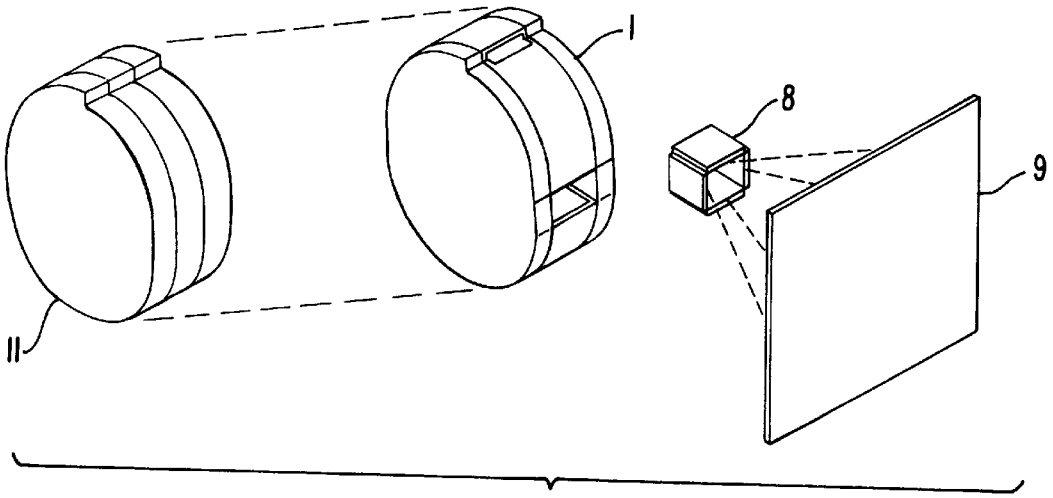
FIG. 5 shows schematic, drawing of a cyclotron display with a single cyclotron or three cyclotron set and a single electrostatic deflection mechanism.
Figure 6:
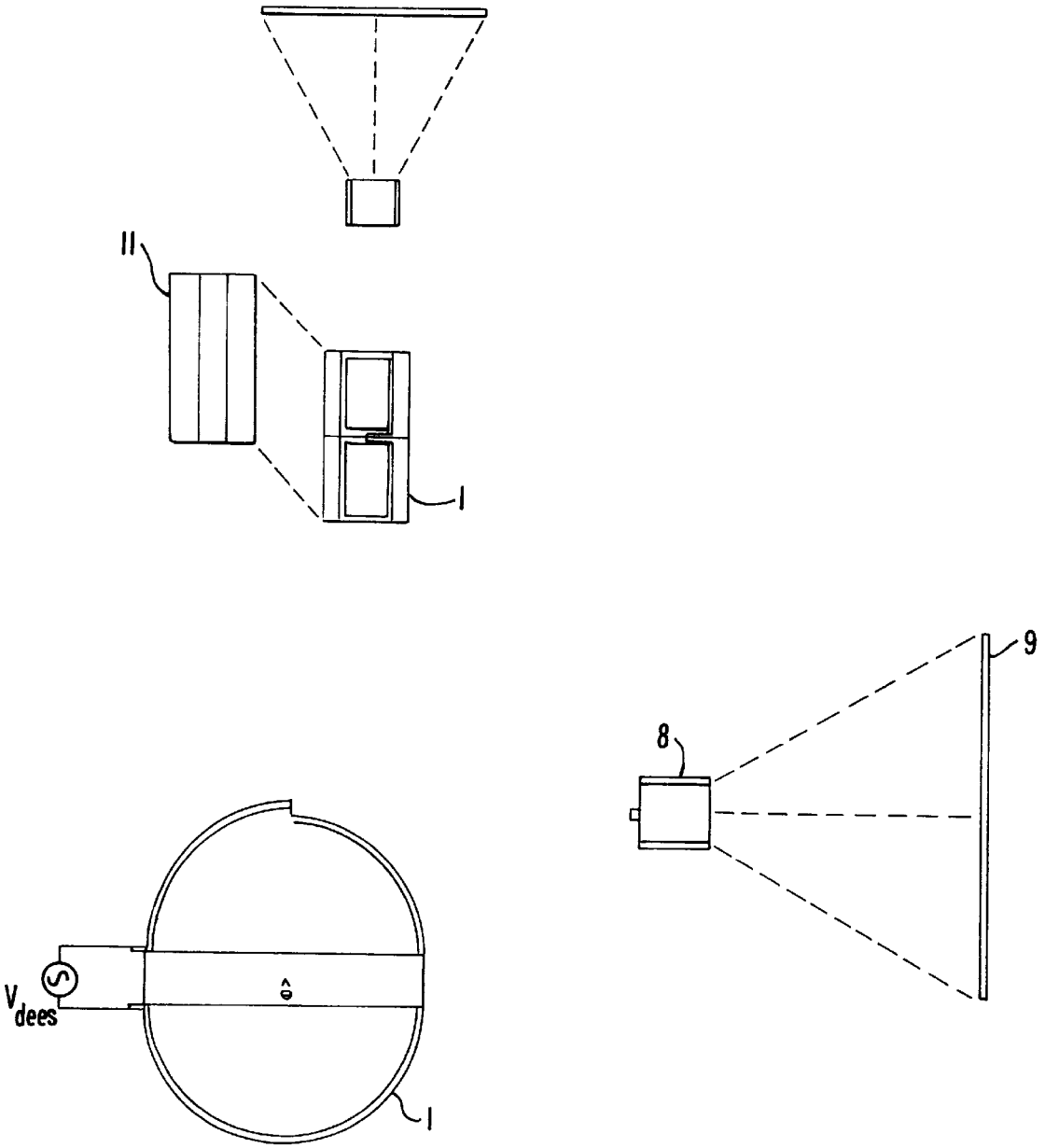
FIG. 6 shows top-view and side-view drawings of a cyclotron display with a single cyclotron or three cyclotron set and a single electrostatic deflection mechanism.

Monochrome Display Unit Comprising a Single Cyclotron and Producing a Single Electron Beam This embodiment of the invention comprises a single cyclotron (see FIGS. 5 and 6). The cyclotron 1 produces a single beam which is appropriately deflected by a deflection unit 8. The electron beam sweeps across phosphor screen 9, in this example a monochrome screen, and strikes the appropriate pixels on that screen to create images, just as it would in a conventional CRT. Methods for controlling deflection of the electron beam to create images on a monochrome display screen are the same as those used in conventional CRT displays, and are well known in the art. A general description of this art is contained in, e.g., Robert A. Meyers, ed., *Encyclopedia of Physical Science and Technology, Second Edition, Vol.* 5, pp. 695–701, Academic Press (San Diego, 1992) and Jerry C. Whitaker, ed., *The Electronics Handbook*, pp. 367–386, CRC Press, Inc. (Beaverton, 1996).

EXAMPLE 2

Figure 7:
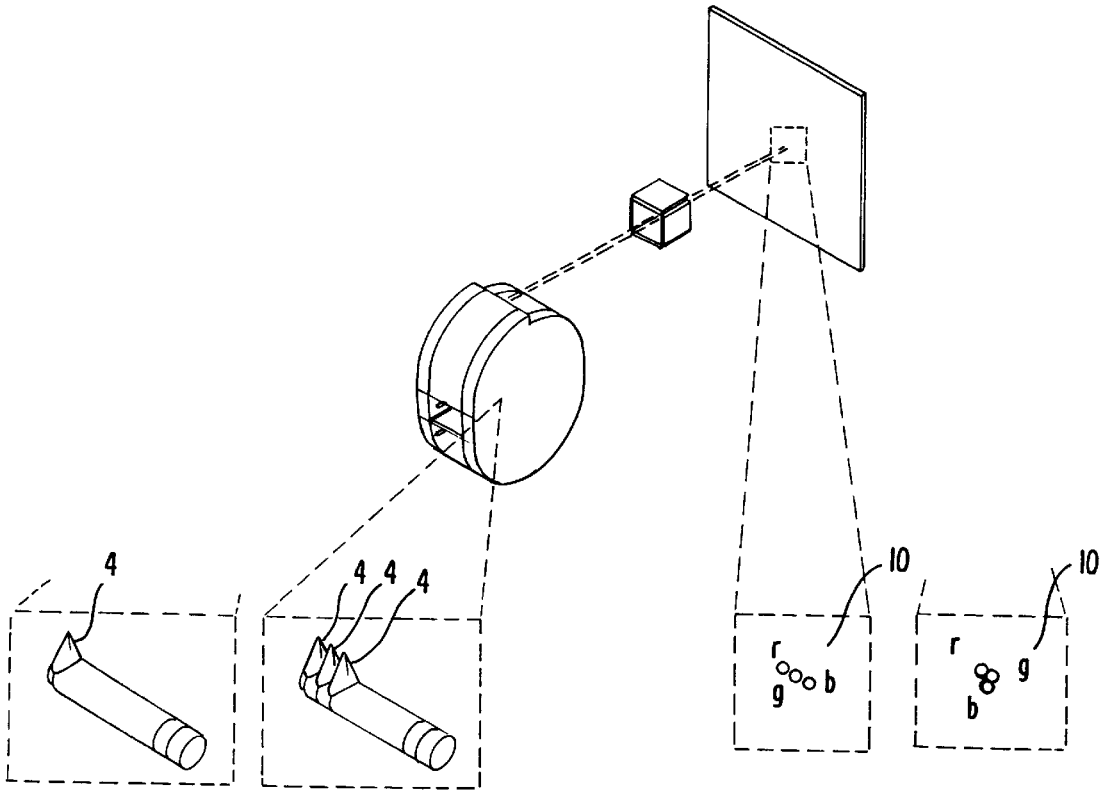
FIG. 7 shows a color cyclotron display.

Color Display Unit Comprising a Single Cyclotron and Producing a Triple Electron Beam This embodiment of the invention comprises a single cyclotron (see FIG. 7). The cyclotron 1 produces a bundle of three electron beams (by one electron source 4 generating three pulses very close in time, or by three separate electron sources 4) which is deflected by a single deflection unit 8 and then strikes the phosphor screen 9, in this example a color screen. The phosphor screen 9 is of the same type used in a conventional CRT. Each pixel 10 on the phosphor screen 9 will contain a red, green and blue phosphor dot, either in delta arrangement, or in parallel arrangement (such as with the Sony Trinitron™ display). Methods for controlling deflection of the electron beam to create images on a color display screen are the same as those used in conventional CRT display, and are well known in the art. A general description of this art is contained in, e.g., Robert A. Meyers, ed., *Encyclopedia of Physical Science and Technology. Second Edition, Vol.* 5, pp. 695–701, Academic Press (San Diego, 1992) and Jerry C. Whitaker, ed., *The Electronics Handbook*, pp. 367–386, CRC Press, Inc. (Beaverton, 1996).

EXAMPLE 3

Color Display Unit Comprising a Set of Three Cyclotrons

This embodiment of the invention comprises a set of three cyclotrons 11 (see FIGS. 5 and 6). The set of three cyclotrons 11 together produce a bundle of three electron beams (one beam from each cyclotron) which is deflected by a single deflection unit 8, or by three separate deflection units (not shown), and then strikes the color phosphor screen 9. Methods for controlling deflection of the electron beam to create images on a color display screen are the same as those used in conventional CRT display, and are well known in the art, as described in Example 2.

EXAMPLE 4

Figure 8:
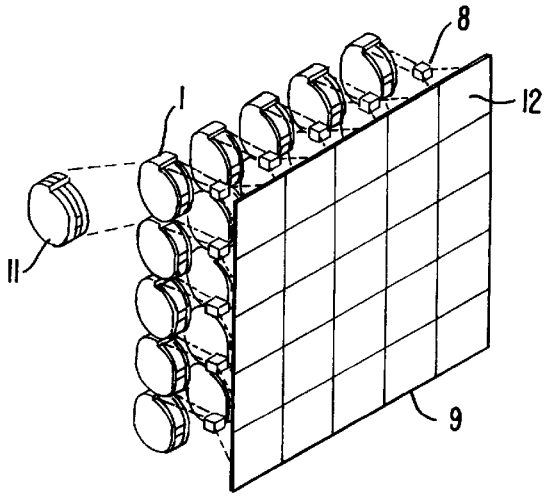
FIG. 8 shows schematic drawing of an array of cyclotrons used in a cyclotron display.
Figure 9:
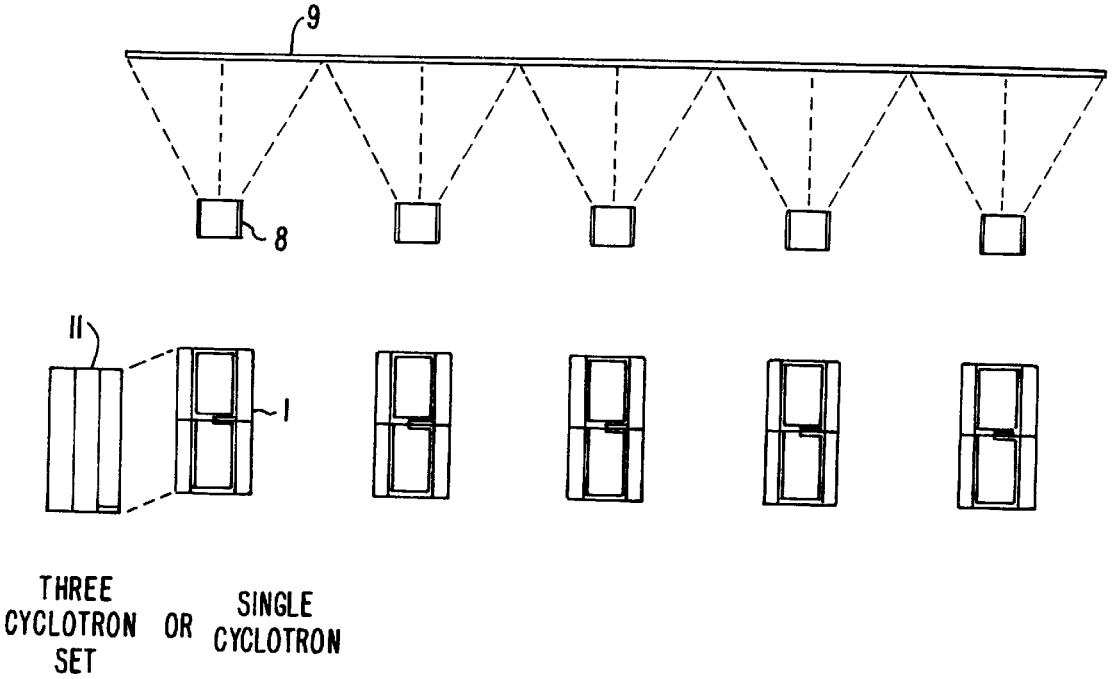
FIG. 9 shows top-view drawing of an array of cyclotrons used in a cyclotron display.

Monochrome Display Unit Comprising an Array of Cyclotrons Each Producing a Single Electron Beam This embodiment of the invention comprises an array of cyclotrons (see FIGS. 8 and 9). Each cyclotron 1 produces a single beam which is deflected by a separate deflection unit 8 and then strikes the monochrome phosphor screen 9 . Each cyclotron 1 and each beam maps to a fractional portion 12 of the screen. Methods for controlling deflection of the electron beam to create images on a monochrome display screen are the same as those used in conventional CRT display, and are well known in the art, as described in Example 1.

The incoming video signal must at some point be processed so that it can be appropriately distributed among the cyclotrons in the array. This process, which is essentially a form of demultiplexion, can be done in combination with a memory chip that temporarily stores the signal (after digitization, if it is an analog signal). Signal demultiplexing is well known in the art. A general description of demultiplexing is contained in, e.g., Paul Horowitz and Winfred Hill, eds., *The Art of Electronics, Second Edition*, pp. 490–504, Cambridge University Press (Cambridge, England, 1989), especially pp. 496–97, and Jacob Millman and Christos Halkias, eds., *Integrated Electronics: Analog and Digital Circuits and Systems*, pp. 609–613, McGraw Hill (New York, N.Y. 1972). Processing of the incoming signal in the disclosed example is also analogous to the processing that is done by video wall displays. Video wall displays contain processors that divide an image intended for a single monitor among several monitors stacked together into an array or wall. This type of signal processing is well-known in the art, as taught in, e.g., U.S. Pat. No. 5,130,794, U.S. Pat. No. 4,635,105 and U.S. Pat. No. 4,563,703.

EXAMPLE 5

Color Display Unit Comprising an Array of Cyclotrons Each Producing a Bundle of Three Electron Beams This embodiment of the invention comprises an array of cyclotrons (see FIGS. 8 and 9). Each cyclotron 1 produces a bundle of three electron beams (by one electron source 4 generating three pulses very close in time, or by three separate electron sources 4) which is deflected by a single deflection unit 8 and then strikes the color phosphor screen 9, just as in Example 2, except that each cyclotron 1 and each bundle maps to a fractional portion 12 of the screen, just as in Example 4. The incoming video signal must at some point be processed so that it can be appropriately distributed among the cyclotrons in the array. This process is described in Example 4.

EXAMPLE 6

Color Display Unit Comprising an Array of Sets of Three Cyclotrons

This embodiment of the invention comprises an array of sets of three cyclotrons 11 (see FIGS. 8 and 9). Each cyclotron set 11 produces a bundle of three electron beams that strikes the color screen 9 just as in Example 5, where each three cyclotron set 11 and each bundle maps to a fractional portion 12 of the screen. Each bundle is deflected by a single deflection unit 8 or by three separate deflection units (not shown). The incoming video signal must at some point be processed so that it can be appropriately distributed among the cyclotrons in the array. This process is described in Example 4.

EXAMPLE 7

Figure 10:
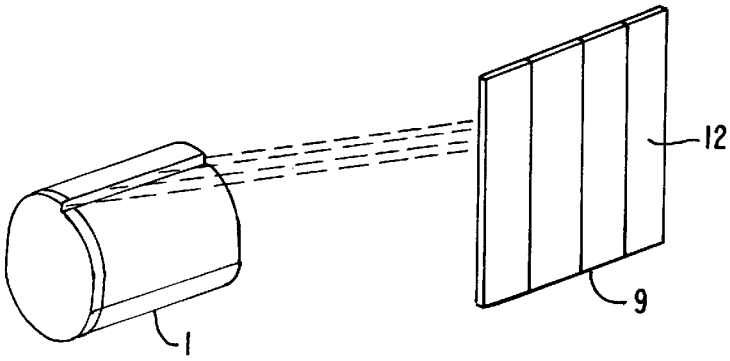
FIG. 10 shows a cyclotron display (monochrome or color) with a cylindrical cyclotron.

Monochrome Display Unit Comprising a Single Cylindrical Cyclotron Each Comprising Multiple Electron Sources This embodiment of the invention comprises a cyclotron comprising multiple electron sources along one dimension (see FIG. 10). The cyclotron 1 emits multiple electron beams through the cyclotron aperture 5. The electron beams then strike the monochrome screen 9, and each electron source 4 and each electron beam maps to a fractional portion 12 of the screen, just as in Example 4. The incoming video signal must at some point be processed so that it can be appropriately distributed among the electron sources in the cyclotron. This process is described in Example 4.

EXAMPLE 8

Color Display Unit Comprising a Single Cylindrical Cyclotron Each Comprising Multiple Electron Sources This embodiment of the invention comprises a cyclotron comprising multiple electron sources along one dimension (see FIG. 10). The cyclotron 1 emits multiple bundles of electron beams through the cyclotron aperture 5, each bundle being produced by a single electron source or by three electron sources. The bundles of electron beams then strike the color screen 9, and each bundle of electron beams maps to a fractional portion 12 of the screen, just as in Example 5. The incoming video signal must at some point be processed so that it can be appropriately distributed among the electron sources in the cyclotron. This process is described in Example 4.

EXAMPLE 9

Monochrome Display Unit Comprising an Array of Cylindrical Cyclotrons

Figure 11:
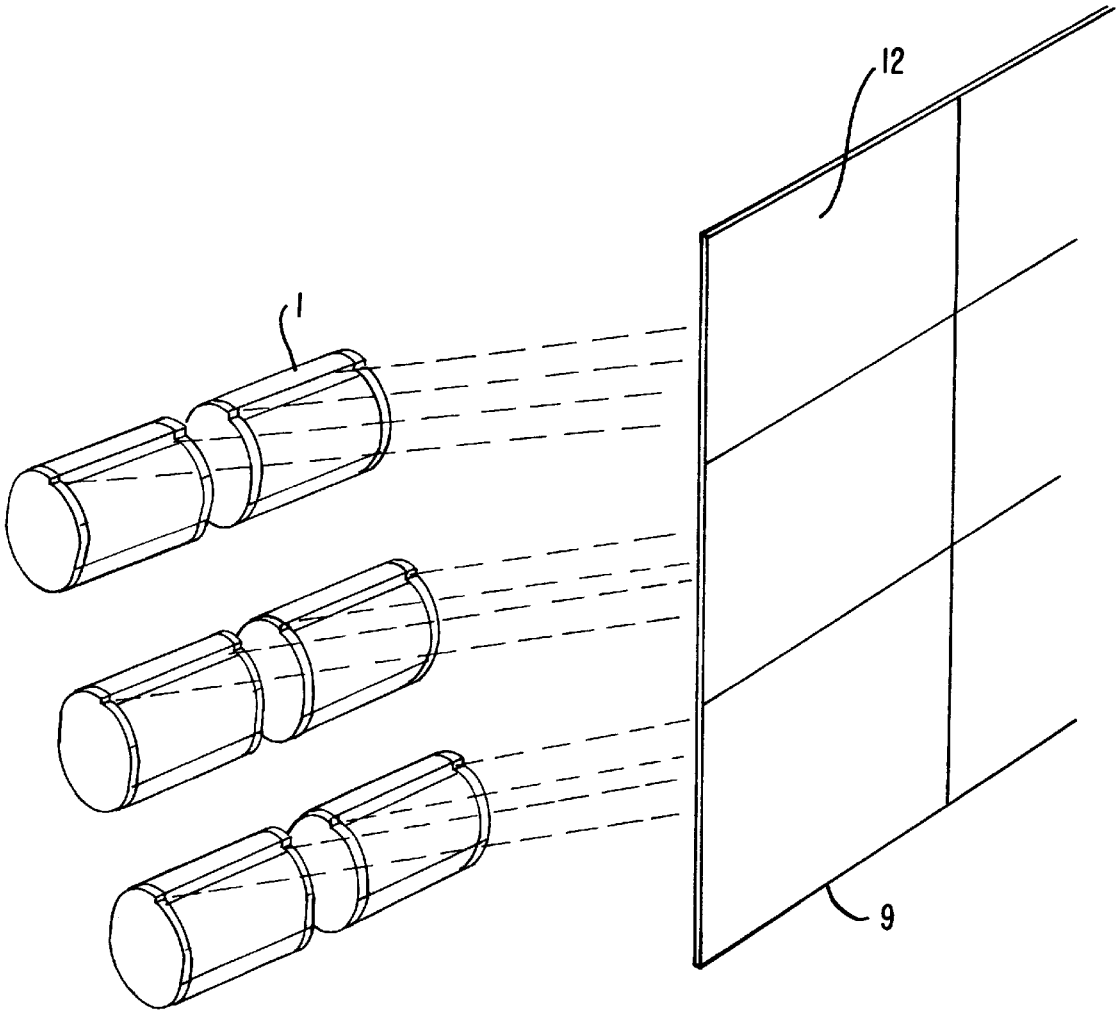
FIG. 11 shows a cyclotron display (monochrome or color) with an array of cylindrical cyclotrons.

This embodiment of the invention comprises an array of cyclotrons comprising multiple electron sources along one dimension (see FIG. 11). The embodiment comprises one or more cyclotrons along one dimension and multiple cyclotrons along another. The cyclotrons 1 emit multiple electron beams through their cyclotron apertures 5. The electron beams then strike the monochrome screen 9, and each electron source and each electron beam maps to a fractional portion 12 of the screen, just as in Example 4. The incoming video signal must at some point be processed so that it can be appropriately distributed among all the electron sources in all the cyclotrons. This process is described in Example 4.

EXAMPLE 10

Color Display Unit Comprising an Array of Cylindrical Cyclotrons

This embodiment of the invention comprises an array of cyclotrons comprising multiple electron sources along one dimension (see FIG. 11). The embodiment comprises one or more cyclotrons along one dimension and multiple cyclotrons along another. The cyclotrons 1 emit multiple bundles of three electron beams through their cyclotron apertures 5, each bundle being produced by a single electron source or by three electron sources. The electron beams then strike the color screen 9, and each bundle of electron beams maps to a fractional portion 12 of the screen, just as in Example 5. The incoming video signal must at some point be processed so that it can be appropriately distributed among all the electron sources in all the cyclotrons. This process is described in Example 4.

The above examples are provided to illustrate the invention but not to limit its scope. Other variants of the invention will be readily apparent to one of ordinary skill in the art and are encompassed by the appended claims. All publications, patents, and patent applications cited herein are hereby incorporated by reference.

What is claimed is:

1. An apparatus for displaying images on a screen, comprising:

a plurality of electron beams produced by one or more cyclotrons, wherein each cyclotron comprises two dees and one or more electron sources;

one or more deflection units for directing the electron beams, wherein each unit comprises at least one deflector that deflects electron beams along a horizontal axis and a second deflector that deflects electron beams along a vertical axis; and a phosphor screen, upon which the electron beams strike, thus creating the images.

2. The apparatus of claim 1, wherein the screen is a monochrome screen.

3. The apparatus of claim 2 wherein there is a plurality of cyclotrons and each of the cyclotrons produces one electron beam directed to a unique fractional portion of the screen.

4. The apparatus of claim 1 wherein the screen is a color screen.

5. The apparatus of claim 4 wherein there is one cyclotron that produces a bundle of three electron beams.

6. The apparatus of claim 4, further comprising a set of three cyclotrons.

7. The apparatus of claim 6 wherein each cyclotron in the set produces a single electron beam and the set produces a bundle of three electron beams.

8. The apparatus of claim 4, wherein there is a plurality of cyclotrons.

9. The apparatus of claim 8 wherein each of the cyclotrons produces a bundle of three electron beams and each bundle is directed to a unique fractional portion of the screen.

10. The apparatus of claim 8, further comprising a plurality of sets of three cyclotrons.

11. The apparatus of claim 10, wherein each cyclotron produces one electron beam and each set produces a bundle of three electron beams directed to a unique fractional portion of the screen.

12. The apparatus of claim 2, wherein there is one cyclotron comprising a plurality of electron sources and each electron source produces an electron beam directed to a unique fractional portion of the screen.

13. The apparatus of claim 4, wherein there is one cyclotron comprising a plurality of electron sources, wherein the cyclotron produces bundles of three electron beams and each bundle is directed to a unique fractional portion of the screen.

14. The apparatus of claim 2, wherein there is a plurality of cyclotrons, each cyclotron comprising a plurality of electron sources and each electron source produces an electron beam directed to a unique fractional portion of the screen.

15. The apparatus of claim 4, wherein there is a plurality of cyclotrons, each cyclotron comprising a plurality of electron sources, wherein each cyclotron produces bundles of three electron beams and each bundle is directed to a unique fractional portion of the screen.

* * * * *